US005277678A

United States Patent [19]

Friedebach et al.

[11] Patent Number: 5,277,678

[45] Date of Patent: Jan. 11, 1994

[54] VIDEO INTERACTIVE SKI EXERCISER

[75] Inventors: Adolf H. Friedebach, Waconia; Paul M. Theisen, Shakopee, both of Minn.

[73] Assignee: Fitness Master, Inc., Waconia, Minn.

[21] Appl. No.: 920,773

[22] Filed: Jul. 28, 1992

[51] Int. Cl.[5] ..... A63B 22/00; A63B 71/00

[52] U.S. Cl. ..... 482/70; 482/8; 482/902; 434/253

[58] Field of Search ..... 482/51, 52, 53, 6–; 434/253

[56] References Cited

U.S. PATENT DOCUMENTS

| | | | |
|---|---|---|---|
| D. 225,342 | 12/1972 | Flick et al. . | |
| D. 225,343 | 12/1972 | Flick et al. . | |
| D. 303,131 | 8/1989 | Lo . | |
| D. 315,764 | 3/1991 | Friedebach . | |
| 3,712,613 | 1/1973 | Feathers et al. | 482/8 |
| 4,023,795 | 5/1977 | Pauls . | |
| 4,278,095 | 7/1981 | Lapeyre | 482/8 |
| 4,323,237 | 4/1982 | Jungerwirth | 482/902 |
| 4,340,214 | 7/1982 | Schutzer . | |
| 4,408,613 | 10/1983 | Relyea | 482/900 |
| 4,434,981 | 3/1984 | Norton . | |
| 4,519,603 | 5/1985 | DeCloux | 482/52 |
| 4,529,194 | 7/1985 | Haaheim . | |
| 4,618,139 | 10/1986 | Haaheim . | |
| 4,632,385 | 12/1986 | Geraci . | |
| 4,645,201 | 2/1987 | Evans . | |
| 4,659,077 | 4/1987 | Stropkay . | |
| 4,684,121 | 8/1987 | Nestegard . | |
| 4,709,918 | 12/1987 | Grinblat . | |
| 4,804,178 | 2/1989 | Friedebach . | |
| 4,813,667 | 3/1989 | Watterson . | |
| 4,867,443 | 9/1989 | Jensen . | |
| 4,900,013 | 2/1990 | Rodgers | 482/70 |
| 4,927,136 | 5/1990 | Leask . | |
| 4,960,276 | 10/1990 | Feuer et al. | 482/70 |
| 5,108,093 | 4/1992 | Watterson . | |
| 5,145,481 | 9/1992 | Friedebach . | |

FOREIGN PATENT DOCUMENTS

| | | | |
|---|---|---|---|
| 2822343 | 11/1979 | Fed. Rep. of Germany | 482/70 |
| 3218086 | 12/1983 | Fed. Rep. of Germany | 482/902 |

OTHER PUBLICATIONS

Fitness Master, Inc., advertising brochure, 1991.

*Primary Examiner*—Stephen R. Crow
*Attorney, Agent, or Firm*—Dorsey & Whitney

[57] ABSTRACT

An improved cross-country skiing simulating exercise machine for providing interactive aerobic conditioning has a base frame, a pair of foot skates movably mounted on the frame, and a pair of arm poles attached to the frame. The frame has two elongate parallel rails, suitably made of extruded aluminum, each having sidewalls with an elongate groove therein with recesses within the grooves thereby forming sidewall tracks. The skates are securely and movably mounted on the rails and have an inclined top surface sloping downwardly in a forwardly direction and a toe kick at their forward end. The arm poles are at the sides of the front end of the frame, and an electronic sensing, control and display assembly is mounted on the frame between the arm poles. An interactive video skate resistance mechanism for automatically adjusting the difficulty of moving the skates is provided.

4 Claims, 2 Drawing Sheets

VIDEO INTERACTIVE SKI EXERCISER

BACKGROUND OF THE INVENTION

The present invention relates to exercise machines. More particularly, it relates to machines for simulating cross-country skiing to exercise both arms and both legs in a natural skiing motion.

Certain devices or machines in the prior art provide the ability to exercise with motions similar to the present invention. Such prior devices are disclosed in U.S. Pat. Nos. 4,529,194, 4,618,139 and 4,948,121, owned by the assignee of the present invention.

Other exercise machines that exercise both the arms and legs include those disclosed in U.S. Pat. Nos. 4,512,571, 4,434,981, 4,023,795, and 2,772,881. Prior art exercise machines that only exercise the legs are disclosed in U.S. Pat. Nos. 4,402,506, 4,406,451, 4,342,452, 3,659,842, 3,582,069, 1,982,843, and U.K. Patent Application GB No. 2,007,987. Additional exercise machines which apparently only exercise the individual's arms are disclosed in U.S. Pat. Nos. 3 2,921,791 and 518,967.

The devices disclosed in the above-identified patents provide exercise for the arms and legs, legs alone, or arms alone. However, none of them disclose exercise machines having means for enabling the machines, and a user, to interact with a video display, thereby increasing the enjoyment and challenge of exercising.

There is a need for an interactive exercise machine that eliminates jarring impact on a user's knees and back while enabling an intense aerobic workout that the user can enjoy.

SUMMARY OF THE INVENTION

An improved cross-country skiing simulating exercise machine for interactive aerobic conditioning has a base frame, a pair of foot skates with rollers attached to each skate permitting the skates to be movably mounted on the frame, and a pair of arm poles attached to the frame. The frame has a plurality of elongate parallel rails, suitably made of extruded aluminum, each having sidewalls each with an elongate groove therein with recesses within the grooves thereby forming sidewall tracks. The rollers of each skate are adapted to be securely and movably mounted within the respective sidewall tracks of the rails to secure the skates to the rails. The skates have an inclined top surface sloping downwardly in a forwardly direction and a toe kick at their forward end. The arm poles are at the sides of the front end of the frame, and an electronic sensing, control and display assembly is mounted on the frame therebetween.

It is an object and advantage of the present invention to provide a video interactive exercise machine that simulates cross-country skiing to provide a safe, smooth, challenging and entertaining aerobic workout, wherein the degree of exercise is automatically variable in accordance with what the user sees.

Another advantage of the present invention is that it provides adjustable arm resistance and automatically or manually adjustable leg resistance, independently of each other.

Another object of the present invention is to provide that a resistance cable, connecting the skates to each other through a resistance adjusting friction brake assembly, may readily have its resistance to movement adjusted as not previously heretofore known.

A feature of the present invention is an integral electronic sensing, control and display module that enables the resistance of the exercise machine to change in response to externally generated sensory data, thereby enabling a user of the machine to react to the perceived sensory data, e.g., a video image, while exercising. The wireless electronic module senses input data and communicates or interlinks it electronically to automatic response means for changing the resistance of the skates to movement while exercise is underway.

Further advantages of the present invention are that it presents an aesthetically pleasing appearance and that the arm poles and the electronics module are foldable to a substantially flat position closely adjacent to the frame, whereby the machine may be stored conveniently in the home.

BRIEF DESCRIPTION OF THE DRAWINGS

The foregoing and other objects and advantages of the invention will become apparent from the following specification and claims, and with reference to the drawings in which:

DESCRIPTION OF THE PREFERRED EMBODIMENT

Figure 1:
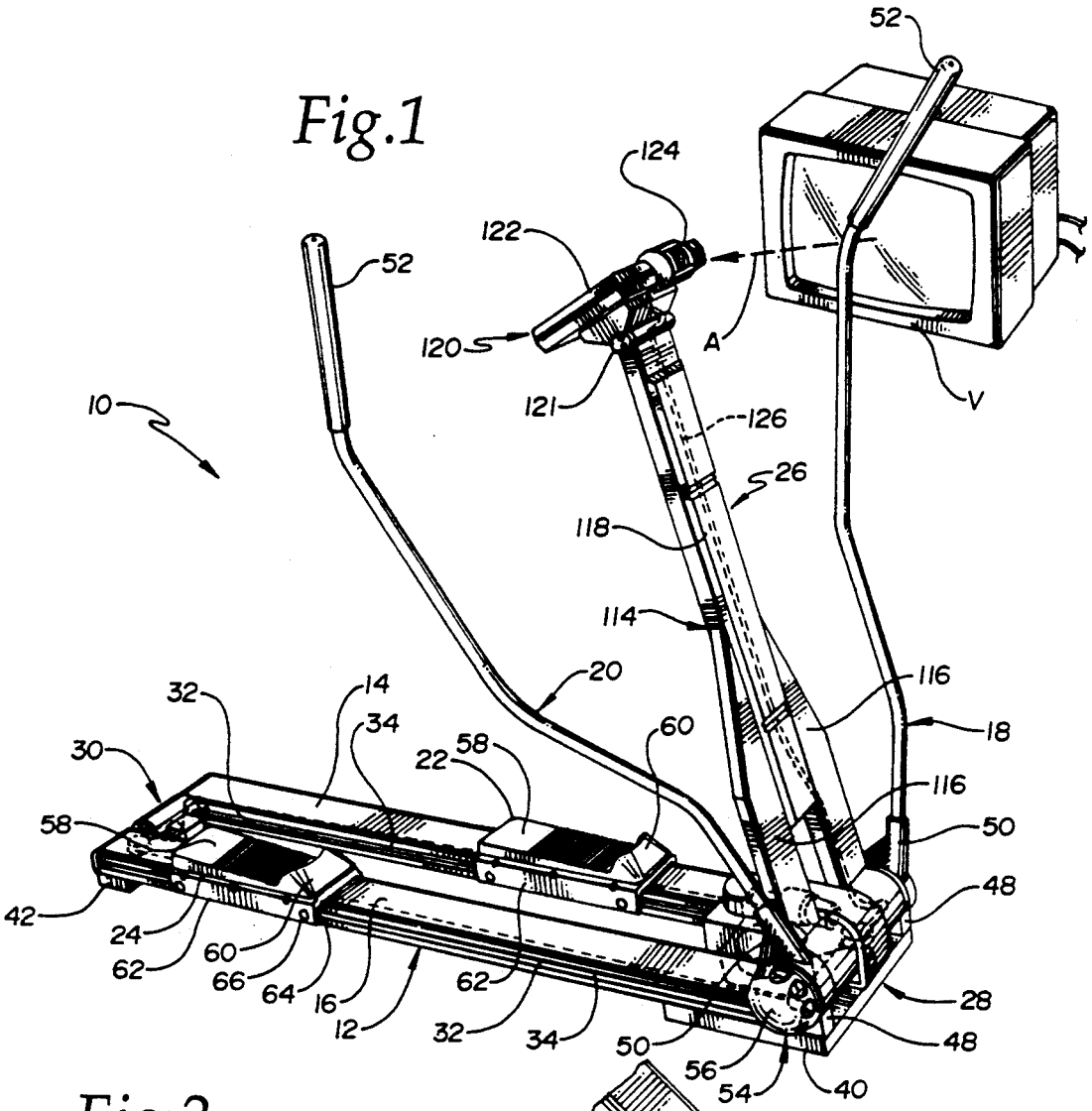
FIG. 1 is a perspective view of the exercise machine of the present invention, including a representational depiction of a video system, namely a video screen.

Referring to FIGS. 1–4, the improved video interactive exercise machine 10 generally includes an elongate frame assembly 12, including left and right rails 14, 16, adjustable arm pole mechanisms 18, 20, left and right inclined foot skates 22, 24, electronics module and mounting assembly 26, automatic foot skate friction brake adjustment assembly and housing 28, and manual cable tension adjustment assembly and housing 30.

More specifically, elongate frame assembly 12 includes a left rail 14 and like right rail 16, both of which are suitably made of elongated extruded aluminum, which preferably is anodized or painted. Rails 14, 16 each have inside and outside sidewalls 32 with elongate tracks or channels 34 therein. Rails 14, 16 are interconnected by front and rear cross members 40, 42, respectively, adapted for resting on a flat floor or surface thereby providing a stable base for the exercise machine 10.

Arm pole mechanisms 18, 20 are substantially mirror images of each other and are operably coupled to the front end of the frame assembly 12 adjacent the front end of the rails 14, 16 at a mounting pads 48. Each arm pole mechanism 18, 20 includes a base or root end 50 and a forwardly curved hand grip 52 which permits comfortable use of the machine 10 by users of various heights. The hand grips 52 are angled forwardly so that they are in a generally vertical, comfortable gripping position when pivoted to their rearmost position. The arm pole mechanisms 18, 20 includes an arm pole pivot and friction brake resistance adjustment assembly 54 adjacent the root ends 50. The arm pole brake assembly 54 is substantially similar to that depicted and claimed in U.S. Pat. No. 4,618,139, which depiction is incorporated herein by reference. The friction brake assembly 54 is operated by a generally semi-spherical adjustment knob 56.

Figure 4:
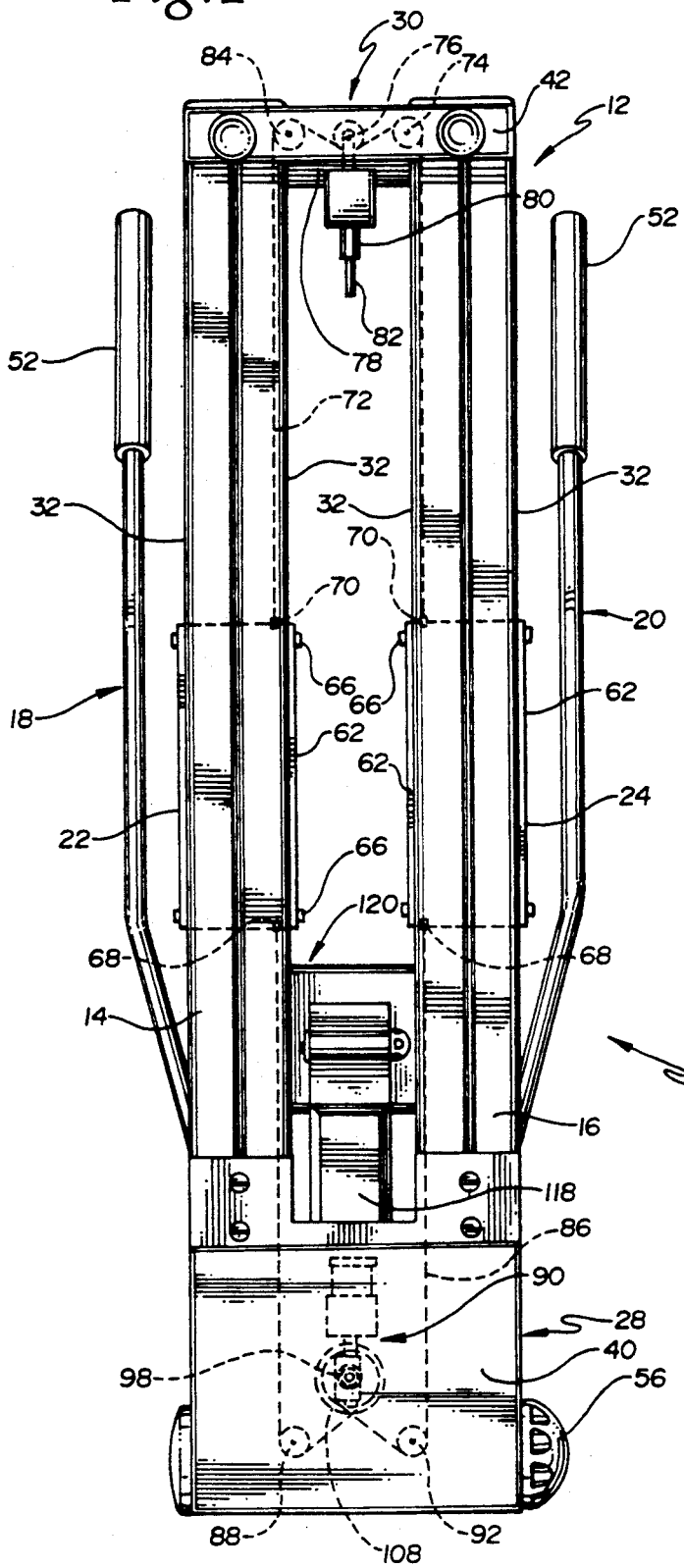
FIG. 4 is a bottom plan view of the invention.

The left and right foot skates 22, 24 are alike, and include an inclined slip resistant top surface 58. At the front end of each skate 22, 24 there is a toe kick 60 for holding the user's feet on the skates 22, 24 as they are alternately pushed forward. Each foot skate 22, 24 has vertical sidewalls 62 for mounting rollers 64 on bearing assemblies 66. Referring to FIG. 4, each skate 22, 24 has a front cable tie 68 and a rear cable tie 70 located on their respective sidewalls 62.

With continued reference to FIG. 4, a continuous rear tensioning cable 72 is connected to the rear cable tie 70 of the right skate 24. The rear cable 72 is suitably made of steel and continues into the rear manual cable tension housing 30, around the right rear pulley 74 and past the tensioning pulley 76. The tensioning pulley 76 is mounted on a carriage 78 within the housing 30. A tension adjustment bolt 80 is connected to the carriage 78 and extends from the housing 30, terminating in a gripping end 82. By adjusting the bolt 80 inwardly or outwardly, the carriage 78 is moved similarly, adjusting the tension of cable 72. The cable 72 further extends around the left rear pulley 84 and is connected to the rear cable tie 70 of the left skate 22.

The front foot skate friction brake adjustment assembly and housing 28 of the present invention includes a continuous front resistance cable 86, suitably made of steel. The cable 86 is appropriately connected to the front tie 68 of the left skate 22 from which cable 86 is wrapped around left front pulley 88. Thereafter, with reference to FIGS. 2 and 4, cable 86 forms a cable loop which wraps around foot skate friction brake assembly 90 in the foot skate friction brake adjustment assembly and housing 28. The brake assembly 90 is suitably mounted on a plate 92 connected to the rails 14, 16. From the brake assembly 90 the cable 86 continues to the right front pulley 92 and is connected conventionally to the front cable tie 68 of the right skate 24. Thus, the left and right skates are interconnected by the cable 86, as well as by the rear tensioning cable 72.

The exercise machine 10 of the present invention, particularly the rear, manual tensioning assembly 30 and the front friction brake 90, as described thus far are substantially as depicted and claimed in U.S. Pat. No. 4,948,121, which depiction is incorporated herein by reference. However, the interactive ski simulator machine 10 of the present invention includes unique refinements and improvements set forth as follows.

Figure 2:
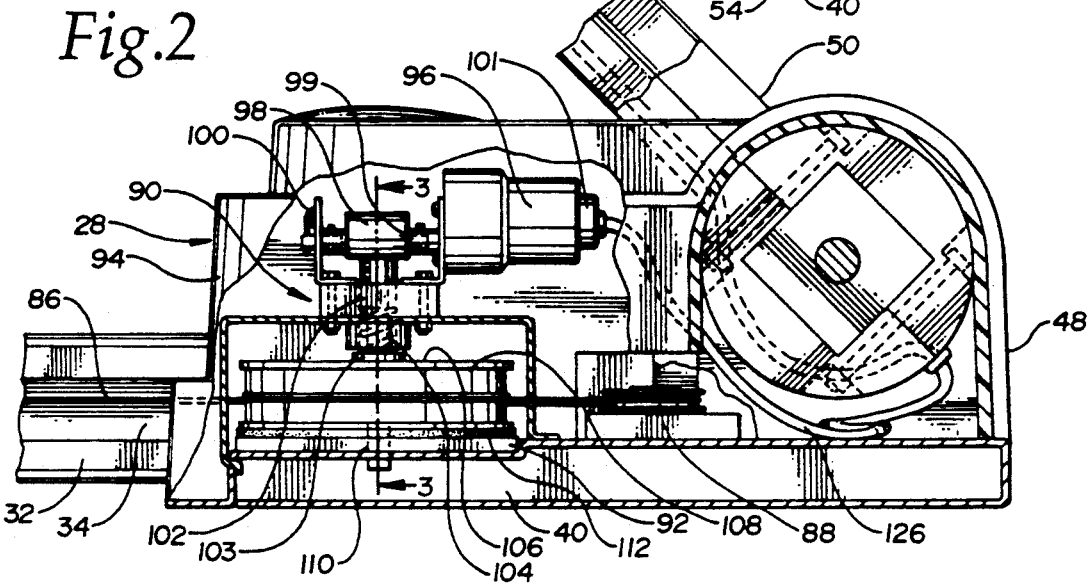
FIG. 2 is a fragmentary elevational view of the invention, partially broken out and in section to reveal details of the skate resistance adjustment means.
Figure 3:
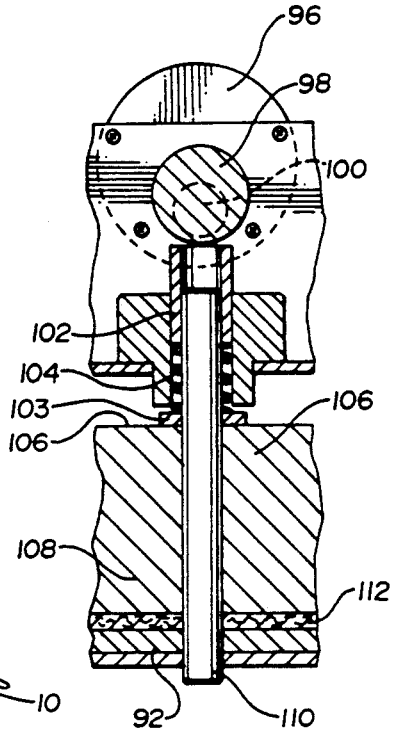
FIG. 3 is a cross sectional view taken along line 3—3 of FIG. 2.

Referring to FIGS. 2 and 3, the front friction brake adjustment mechanism and housing 28 includes a top central shroud 94 suitably connected to the rails 14, 16 and the front cross member 40. A commercially available reversible electrical servomotor 96 is mounted inside the shroud 94 adjacent to the brake assembly 90. An eccentric cam 98 is operably mounted on the output shaft 99 of the motor 96, as is a stop 100. An electric cam position sensor and indexor 101 is mounted immediately adjacent to and in contact with the motor 96 and cam 98. The cam 98 is above the brake assembly 90 and a generally cylindrical U-shaped cam follower sleeve 102 is operably mounted between the cam 98 and the brake assembly 90. The cam follower 102 captures a coil spring 104, one end of which contacts, either directly or through a shoe 103, the upper surface 106 of the friction brake member 108 of the brake assembly 90. A friction disk 112, made from appropriate material such as leather, is fixedly attached to the underside of the brake member 108. The brake member 108 and associated disk 112 float upwardly and downwardly about a thrust spindle 110. The spring 104, captured between the cam follower 102 and the brake member 108, biases the cam follower 102 upwardly against the cam 98 and tends to drive the brake member 108 and disk 112, particularly the disk 112, into frictional contact with the plate 92. The amount of friction between the disk 112 and plate 92 is dependent on the distance between the surface of the cam 98 and the surface of the brake member 108. A larger cam radius decreases the distance, thereby increasing the friction and making the rotation of the brake member 108 more difficult. Because the cable 86 is looped about the brake assembly 90, specifically, the brake member 108, and attached to the skates 22, 24, it thus becomes more difficult for the user of the machine 10 to move the skates 22, 24 requiring more exertion from the user.

Referring to FIGS. 1 and 2, the electronics module and mounting assembly 26 of the present invention comprises a yoke support 114 having two arms 116 each pivotally coupled to the front of the machine 10. The pivot coupling of the yoke arms 116 is coaxial with the pivot coupling of the arm poles 18, 20. A central mast 118 is generally coplanar with and rigidly supported between the two arms 116. The yoke 114 pivots from a flat storage position immediately adjacent the rails 14, 16 to an upright use position (depicted in FIG. 1), wherein the yoke 114 is angled approximately 10 degrees from vertical. The yoke is held in the latter position by a suitable, conventional snap detent latch mechanism (not shown).

A control and sensing unit 120, including a display panel 122, is pivotally mounted at the top of the mast 118. The angle of the control unit 120 from horizontal may be adjusted to provide for comfortable use by persons of various heights by using the adjustment knob 121 to loosen the pivotal connection between the unit 120 and the upper end of the mast 118. The control unit 120 has a sensory input receiver 124 at its front, leading edge for receiving external data which is then processed by the unit 120. The unit 120 may be equipped with appropriate, user operated touch controls and displays such as power on/off, elapsed time indicators, stroke counters, and resets. For example, a resistance level readout which receives data from the sensor and indexor 101 may be provided to inform a user about the initial and subsequent resistance levels. A suitable power cord 126, running through the yoke 114, connects the output of the control unit 120 to the input of the servomotor 96.

In preparation for operation of exercise machine 10, the user erects the module and mounting assembly 26 and arm poles 18, 20, and adapts the control unit 120 appropriately to the source of sensory data and activates it. Sensory input might include electric current, video images or pixels arranged in a pre-selected way on a particular video tape, infrared signals, digital impulses or radio waves. The machine of the present invention also can be used in a stand alone mode, wherein no input is required. The arm pole resistance may be adjusted manually to the desired level, the rear cable tensioning pulley 76 may be adjusted manually to remove any slack in cable 72, and base or initial skate resistance may be selected by using the control unit 120 to direct the servomotor 96 to position the cam 98 in a preset or base skate resistance position.

Next, the user steps on left and right foot skates 22, 24 and grips the arm poles 18, 20. Thereafter, aerobic conditioning may commerce similar to a cross-country skiing motion. The sensor 124 will pick up the data directed to it and the control unit 120 processes or converts the sensory data to an electrical control current or impulses, then conveyed to the servomotor 96. The motor 96 is actuated either forwardly or backwardly by the control current and positions the cam 98 to bring about the desired, commensurate degree of skate resistance. The wiper arm switch 101 senses the position of the cam 98 and sends a feedback signal to the control unit 120 for processing into position-of-the-cam display information for the user.

For example, the control unit 120 may be interlinked to a video system, represented by video screen V in FIG. 1. The user views video screen V, perhaps seeing images of a cross-country ski trail. The video system, or video tape itself, transmits or provides to the control unit 120 preselected codes or signals, represented by arrow A, corresponding to the relative effort required to ski the trail shown on the screen. If the video image is one of skiing up a hill, the control unit 120 receives appropriate signals and links or communicates them to the skate friction brake assembly 28, specifically, the servomotor 96, which automatically increases the degree of resistance thereby providing a more realistic and challenging simulation of skiing for the user.

The present invention may be embodied in other specific forms without departing from the spirit or essential attribute thereof, and it is desired that the present embodiment be considered in all respects as illustrative and not restrictive, reference being made to the appended claims rather than to the foregoing description to indicate the scope of the invention.

What is claimed:

1. An exercise machine for providing various degrees of exercise for a user of the machine, said machine including means for processing information from a source external relative to the machine and user and means for varying the degree of exercise the user receives, said means for varying the degree of exercise operably coupled to said means for processing information, whereby the degree of exercise is automatically adjusted in response to said information, said means for processing information comprising a sensor means for sensing said information and a processor means for converting said information into electric current, said means for varying the degree of exercise comprising an electrically powered friction brake assembly including a plate member, a brake member, a friction disk, an electrical motor operable in response to said electrical current, a cam operably connected to said motor, and a cam follower adjacent said cam and between said cam and brake member, said cam follower acting on said brake member to increase the friction between said friction disk and said plate member.

2. An exercise machine, comprising:

a frame assembly having two elongate parallel rails each having sidewalls with an elongate groove with an elongate recess therein forming sidewalk tracks;

a pair of arm pole mechanisms;

a pair of foot skates with attached rollers, said rollers movably received in the sidewall tracks, said foot skates being connected by at least one cable received and guided by a plurality of pulleys attached to the frame assembly;

interactive means for receiving an external input signal and processing said signal into an electrical current; and a skate friction brake assembly for receiving said cable and varying the difficulty of moving the skates including a plate member fixedly mounted on said machine, a brake member, a friction disk, an electrical motor operable in response to said electrical current, a cam operably connected to said motor, and a cam follower adjacent said cam and between said cam and brake member, said cam follower acting on said brake member to increase the friction between said friction disk and said plate member.

3. An interactive exercise machine for providing aerobic conditioning exercise for a user, said machine having a frame assembly, a pair of foot skates movably mounted on the frame assembly, a pair of arm pole mechanisms attached to the frame assembly and including selectively variable resistance means for adjusting the difficulty of moving the arm pole mechanisms, skate resistance means for varying the resistance of the skates to movement and interactive means for sensing external information and for processing said information into electrical signals, said skate resistance means acting in response to said electrical signals to vary the resistance of said skates to movement, being connected by a connecting member and said skate resistance means comprising a brake assembly mounted on a rigid member and including a pulley means for receiving said connecting member and an adjacent friction disk, an electrical motor operable in response to said electrical signals, a cam operably connected to said motor, a cam follower adjacent said cam and between said cam and said pulley, said cam follower acting on said brake assembly to change the friction between said friction disk and said rigid member.

4. The exercise machine of claim 3, wherein said resistance means includes feedback means for sensing the position of said cam and sending a signal back to said processing means.

* * * * *